United States Patent [19]

Regan

[11] 4,206,795

[45] Jun. 10, 1980

[54] STORED COLLAPSIBLE BAG FOR EXTENSION ABOUT A TREE FOR DISPOSAL OF THE TREE

[76] Inventor: Michael E. Regan, 4006 Girard Ave. N., Minneapolis, Minn. 55412

[21] Appl. No.: 26,092

[22] Filed: Apr. 2, 1979

[51] Int. Cl.[2] ..... B65D 85/70

[52] U.S. Cl. ..... 150/52 R; 206/303

[58] Field of Search ..... 206/303; 53/390; 150/52 R; 248/38, 44, 46, 47, 48

[56] References Cited

U.S. PATENT DOCUMENTS

| | | | |
|---|---|---|---|
| 633,528 | 9/1899 | Morris | 150/52 R |
| 2,748,516 | 6/1956 | McClusky | 150/52 R |
| 2,781,811 | 2/1957 | Dilar | 150/52 R |
| 2,868,255 | 1/1959 | Fancher | 150/52 R |
| 2,911,025 | 11/1959 | Paros | 150/52 R |
| 3,729,039 | 4/1973 | Walsh | 150/52 R |
| 3,750,731 | 8/1973 | Brimmell | 150/52 R |
| 3,872,906 | 3/1975 | Bolanz | 150/52 R |
| 3,954,129 | 5/1976 | Rudell | 150/52 R |
| 4,013,099 | 3/1977 | Gerick | 206/303 |
| 4,064,673 | 12/1977 | Gerick | 206/303 |

*Primary Examiner*—Donald F. Norton

*Attorney, Agent, or Firm*—Wicks & Nemer

[57] ABSTRACT

A stored collapsible bag for extension about a Christmas tree or the like for disposal of the tree including a bag having a hole in the bottom thereof through which a tree trunk is extended. The bag is placed in a container having a centrally positioned collar which extends through the hole in the bag and through which the trunk of a tree is extended. The container has a removable top which when removed allows the bag to be extended about the tree and enclose the same.

3 Claims, 9 Drawing Figures

STORED COLLAPSIBLE BAG FOR EXTENSION ABOUT A TREE FOR DISPOSAL OF THE TREE

SUMMARY

The invention relates broadly to bags and more particularly to a bag for enclosing an item therein. More specifically the invention relates to a bag having a container for mounting on the trunk of a Christmas tree with subsequent extension of the bag from the container for encapsulation of the tree by the bag whereby the tree may be moved without the needles or branches of the tree falling to the floor when the tree is moved for disposal thereof. The bag may also be extended from the container and placed in opened position beneath the tree and on the floor on which the tree is positioned whereby the bag catches needles which may fall from the tree.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
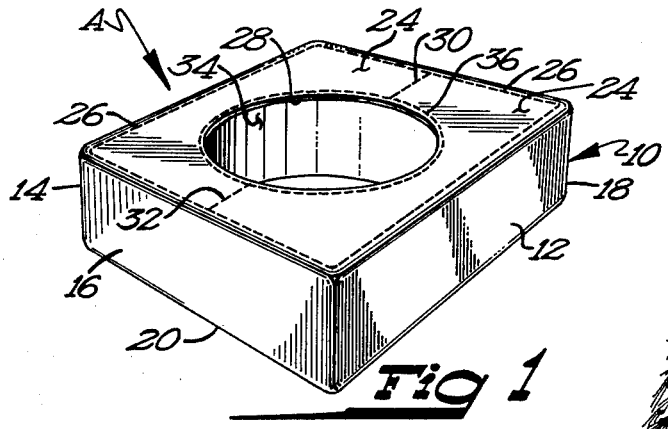
FIG. 1 is a perspective view of a container with collapsible bag for extension about a Christmas tree for disposal of the tree and embodying the invention.
Figure 2:
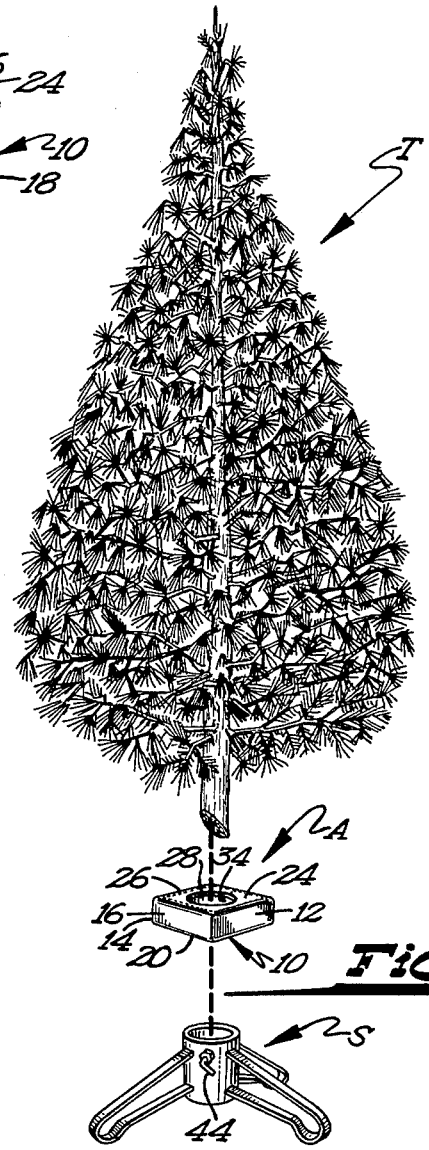
FIG. 2 is an exploded perspective view of the stored bag in an initial position for positioning the same upon the trunk of a tree.

Referring to the drawings in detail, the container with collapsible bag A includes the hollow box 10 formed of the first and second sidewalls 12 and 14 which are connected to the third and fourth sidewalls 16 and 18. Secured to the lower edges of the sidewalls is the bottom 20. The bottom 20 has a hole 22 formed centrally therethrough.

The numeral 24 designates a top which is connected to upper edges of sidewalls by means of glue or other conventional means. The top is perforated closely adjacent the outer edge thereof with the perforations 26 which weaken the top sufficiently so that it may be easily torn off the container. The top is also formed with the central opening 28 and the lines of perforations 30 and 32 which allow the top to be removed when a tree trunk is extended through the central opening as hereinafter referred to.

The numeral 34 designates a substantially rigid collar which is secured at its upper edge to the edge of the opening 28 of the top with the top separable from the collar by breaking at the perforations 36 formed in the top closely adjacent the top edge of the collar as hereinafter referred to. The collar 34 may also be made of elastic material whereby the collar grips the tree trunk so that needles which may fall from the tree do not fall and pass between the trunk of the tree and the collar.

Further provided is the thin flexible bag 38 having an open top and the bottom 40. The bottom 40 of the bag has a hole 42 formed therein and which is substantially the size of the collar 34.

Figure 3:
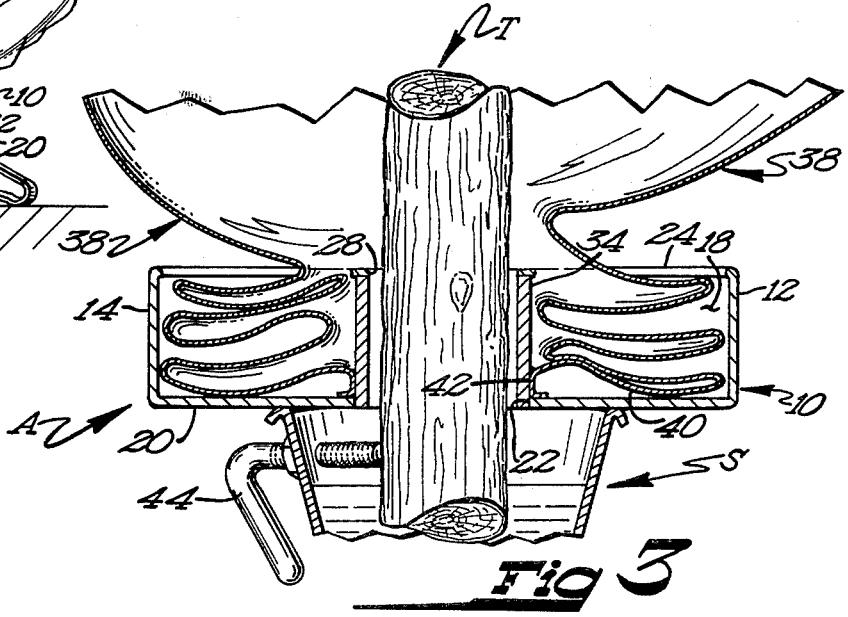
FIG. 3 is a sectional view of the container in position upon the trunk of a tree with the cover removed and the bag partially extended from the container.
Figure 5:
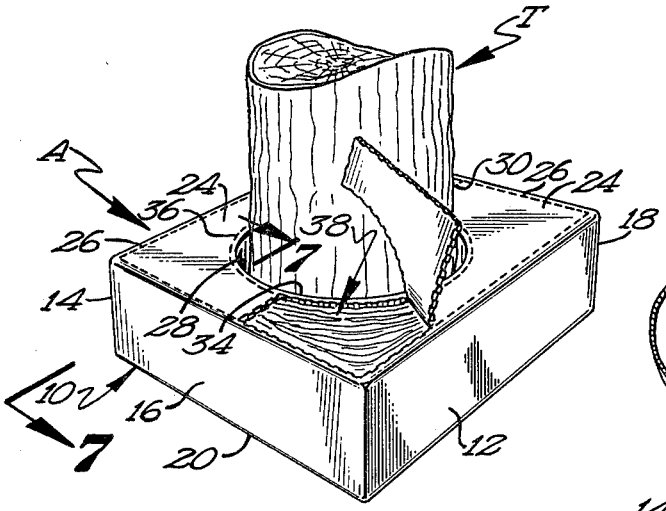
FIG. 5 is a perspective view of the container about the trunk of a tree with a portion of the cover of the container removed.
Figure 6:
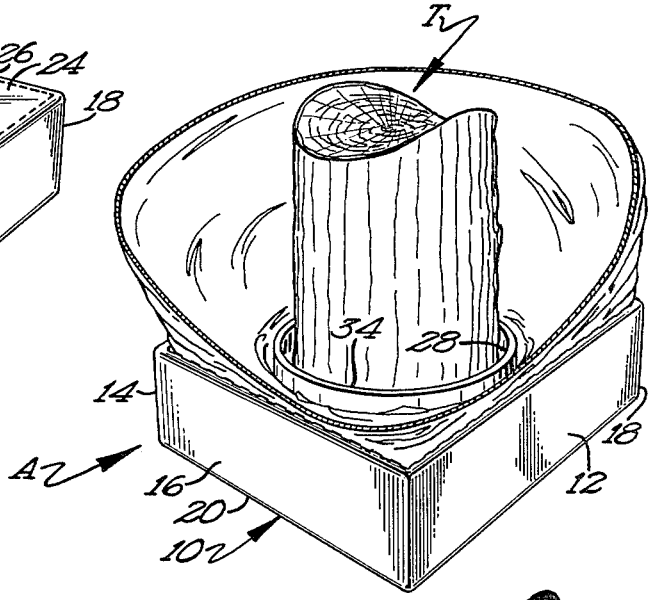
FIG. 6 is a perspective view similar to that of FIG. 5 but with the container cover removed and the bag partially removed from the container.

In assembly of the device A the bag is positioned with the collar 34 extended through the hole 42 of the bag with hole 42 attached by glue or other conventional methods to the bottom 20 and sides of the collar 34, particularly FIG. 3. The bag is then folded and compressed whereby it is received within the container or box 10 and about the collar 34. The top 24 is secured to the sidewalls and collar as heretobefore described whereby the device appears as in FIG. 1.

OPERATION

Figure 4:
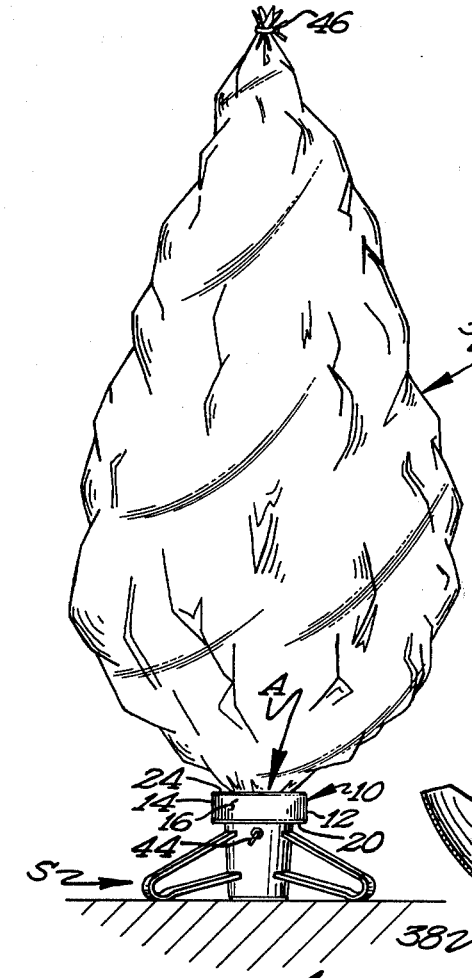
FIG. 4 is a side elevational view of a tree with the container in position on the trunk of the tree with the bag removed therefrom and extended and secured about the tree.

First, the trunk of the tree T is inserted through the collar 34 and then mounted and secured in the tree stand S by means of the thumb screws 44 whereby the device A rests upon the tree stand S, FIGS. 3 and 4.

When it is desired to encapsulate the tree T in the bag 38, the top 24 of the box 12 is removed by separating the same by tearing along the perforations 26. The top of the box is then removed from the trunk of the tree by tearing at the perforations 30 and 32. With the top 24 removed from the box, the bag is pulled from the box upwardly and around the tree to the top thereof where the bag is closed off about the tree by means of a tie 46 as in FIG. 4. With the thumb screws 44 released the tree with the bag enclosing the same is removed from the tree stand whereby the tree may be carted away with any loosened needles, due to movement of the tree, captured within the bag.

As the bag is drawn upwardly from the box 10 and about the tree the bottom of the bag is held at the bottom trunk of the tree by engagement of the box against the lower branches of the tree inasmuch as the lower end of the bag is secured to the box as heretobefore described.

Figure 9:
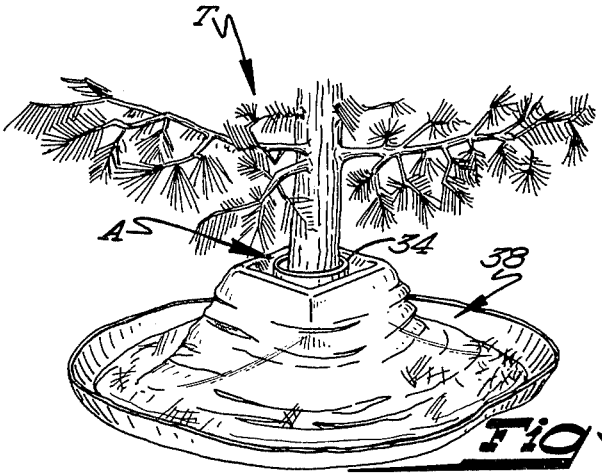
FIG. 9 is a perspective view of the bag removed from the container and placed on the floor under the tree.
Figure 7:
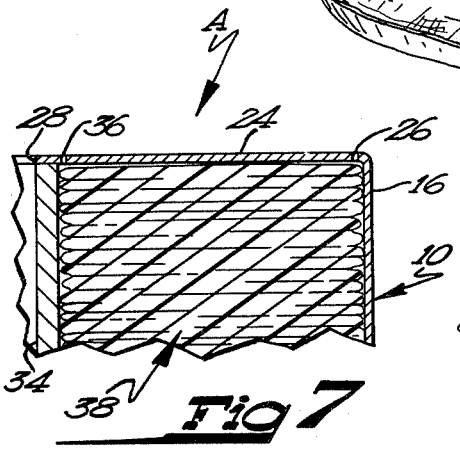
FIG. 7 is an enlarged sectional view on the line 7—7 of FIG. 5.
Figure 8:
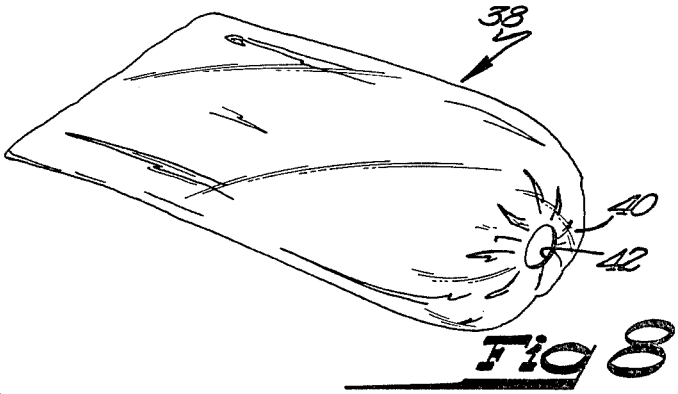
FIG. 8 is a perspective view of the bag removed from the container.

The bag may be pulled from the container and spaced out below the tree as illustrated in FIG. 9 whereby needles falling from the tree as it stands during use are caught by the bag and scooped up as the bag is later extended upwardly about the tree for carrying the tree as heretobefore referred to.

Having thus described the invention, what is claimed as new and desired to be secured by Letters Patent is:

1. A stored collapsible bag for extension about a tree for disposal of the tree comprising:

(a) a bag having a hole in the bottom thereof (b) a container having a hole in the bottom thereof and through which the trunk of a tree can be extended, (c) means mounting said bag in said container with the hole of the bag in alignment with the hole in the bottom of the container, (d) means maintaining said bag in said container in compressed form, and (e) means for releasing said maintaining means to allow said bag to be extended from said container and about a tree with the trunk of the tree extended through said hole of said bag and the hole of said container.

2. The device of claim 1 in which said means maintaining said bag in said container includes;

(a) a top having an opening therein and in alignment with said hole in said bottom and through which a tree is extended, and (b) means releasably connecting said top to said container to allow said top to be removed and said bag to be extended from the container and about a tree.

3. The device of claim 2 in which said means mounting said bag in said container with the hole of the bag in alignment with the hole of the container includes a collar carried by said container coaxially of said hole of said bag and said hole of container and through which a trunk of a tree is extended.

* * * * *